US009417023B2

(12) United States Patent
Smith

(10) Patent No.: US 9,417,023 B2
(45) Date of Patent: Aug. 16, 2016

(54) METHODS AND APPARATUS FOR FLASH SUPPRESSION

(71) Applicant: Smith Enterprise, Inc., Tempe, AZ (US)

(72) Inventor: Ronald Smith, Tempe, AZ (US)

(73) Assignee: Smith Enterprise, Inc., Tempe, AZ (US)

( * ) Notice: Subject to any disclaimer, the term of this patent is extended or adjusted under 35 U.S.C. 154(b) by 19 days.

(21) Appl. No.: 14/568,420

(22) Filed: Dec. 12, 2014

(65) Prior Publication Data

US 2015/0308776 A1 Oct. 29, 2015

Related U.S. Application Data

(60) Provisional application No. 61/921,682, filed on Dec. 30, 2013.

(51) Int. Cl.
*F41A 21/00* (2006.01)
*F41A 21/34* (2006.01)

(52) U.S. Cl.
CPC ..... *F41A 21/34* (2013.01)

(58) Field of Classification Search
CPC ..... F41A 21/34; F41A 21/36; F41A 21/30; F41A 21/325
USPC ..... 89/14.2, 14.3
See application file for complete search history.

(56) References Cited

U.S. PATENT DOCUMENTS 5,596,161 A 1/1997 Sommers
6,722,254 B1 * 4/2004 Davies ..... F41A 21/36 42/1.06
6,837,139 B2 * 1/2005 Meyers ..... F41A 21/34 42/77
7,861,636 B1 * 1/2011 Hoffman ..... F41A 21/34 89/14.2
8,061,254 B2 * 11/2011 Heath ..... F41A 21/34 89/14.2
8,418,803 B2 * 4/2013 Findlay ..... F41A 21/30 181/223
8,490,534 B1 * 7/2013 Moore ..... F41A 21/34 181/223
8,769,852 B2 * 7/2014 Coleman ..... F41A 21/34 42/1.06
9,046,316 B1 * 6/2015 Young ..... F41A 21/30
9,261,319 B1 * 2/2016 Palu ..... F41A 21/34
2005/0066802 A1 * 3/2005 Meyers ..... F41A 21/34 89/14.2
2010/0229713 A1 * 9/2010 Heath ..... F41A 21/34 89/14.2
2012/0125184 A1 * 5/2012 Meyers ..... F41A 21/34 89/14.2
2012/0228052 A1 * 9/2012 Findlay ..... F41A 21/30 181/223
2014/0196599 A1 * 7/2014 Kenney ..... F41A 5/28 89/193
2015/0308774 A1 * 10/2015 Sherrill ..... F41A 21/36 89/14.2
2015/0308775 A1 * 10/2015 Packard ..... F41A 21/34 89/14.2
2015/0377577 A1 * 12/2015 Pappas ..... F41A 21/34 89/14.2

* cited by examiner

*Primary Examiner* — Samir Abdosh
(74) *Attorney, Agent, or Firm* — The Noblitt Group, PLLC

(57) ABSTRACT

Methods and apparatus for flash suppression according to various aspects of the present technology may comprise a body that is configured to be selectively coupled to a firearm. The body may be formed with curved and or arcing protrusions extending longitudinally along the body. Each protrusion is separated from another protrusion by a gap configured to dissipate gases and unburned materials exiting the barrel of the firearm.

26 Claims, 3 Drawing Sheets

METHODS AND APPARATUS FOR FLASH SUPPRESSION

CROSS-REFERENCES TO RELATED APPLICATIONS

This application claims the benefit of U.S. Provisional Patent Application No. 61/921,682, filed Dec. 30, 2013, and incorporates the disclosure of the application by reference.

BACKGROUND OF INVENTION

When a firearm is discharged, gases generated by combustion of an explosive mixture in the firearm chamber propel a projectile through the firearm barrel and out the muzzle. These propellant gases exit the muzzle in the wake of the projectile and mix with the ambient air. The exiting gases cause or contribute to unwanted effects including, muzzle flash, recoil/muzzle lift, and interference with projectile stability.

Muzzle flash results from contact of the propellant with air at the muzzle. The propellant gas mixture, containing traces of unburned powder, remains extremely hot at the end of the barrel. Oxygen in the surrounding air combines with the hot gas to enable combustion of the residual chemicals, resulting in a visible flash of light just beyond the end of the barrel. Muzzle flash is undesirable because, among other things, it gives away the location of a shooter at night or under other low ambient light conditions.

Recoil is the reactive force against the gun barrel applied by the moving bullet and propellant. A substantial component of this reactive force is created by the forward ejection of the propellant out the muzzle. The recoil force is typically applied at a point above the center of gravity of the firearm and this, combined with the torque reaction generated by the rapidly spinning projectile, tends to pull the muzzle upward and to the right upon firing.

Projectile stability is affected by the exiting propellant gas that passes and surrounds the projectile immediately beyond the muzzle. The velocity of the propellant is typically about twice the velocity of the projectile, so that at exit some propellant moves around and in front of the projectile. The propellant immediately slows down in the air, causing drag on the projectile. More significantly, in the case of a firearm with a rifled barrel, the propellant exerts a force that makes the spinning projectile wobble or "yaw", thereby causing the projectile to take longer to stabilize and decreasing the accuracy of the firearm.

SUMMARY OF THE INVENTION

Methods and apparatus for flash suppression according to various aspects of the present technology may comprise a body that is configured to be selectively coupled to a firearm. The body may be formed with curved and or arcing protrusions extending longitudinally along the body. Each protrusion is separated from another protrusion by a gap configured to dissipate gases and unburned materials exiting the barrel of the firearm.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional elements and various processing steps. Such functional elements may be realized by any number of components configured to perform the specified functions and achieve the various results. For example, the present technology may employ various types of materials, fastening devices, surface finishes and the like, which may carry out a variety of functions. In addition, the present technology may be practiced in conjunction with any number of processes for reducing secondary combustion, concealing locations, and sound suppression, and the system described is merely one exemplary application for the invention. Further, the present technology may employ any number of conventional techniques for metalworking, component manufacturing, tooling fabrication and/or forming surfaces.

Methods and apparatus for flash suppression according to various aspects of the present technology may operate in conjunction with any suitable flash suppression system. Representative implementations of the present technology may also be applied to a variety of devices capable of firing projectiles.

Figure 1:
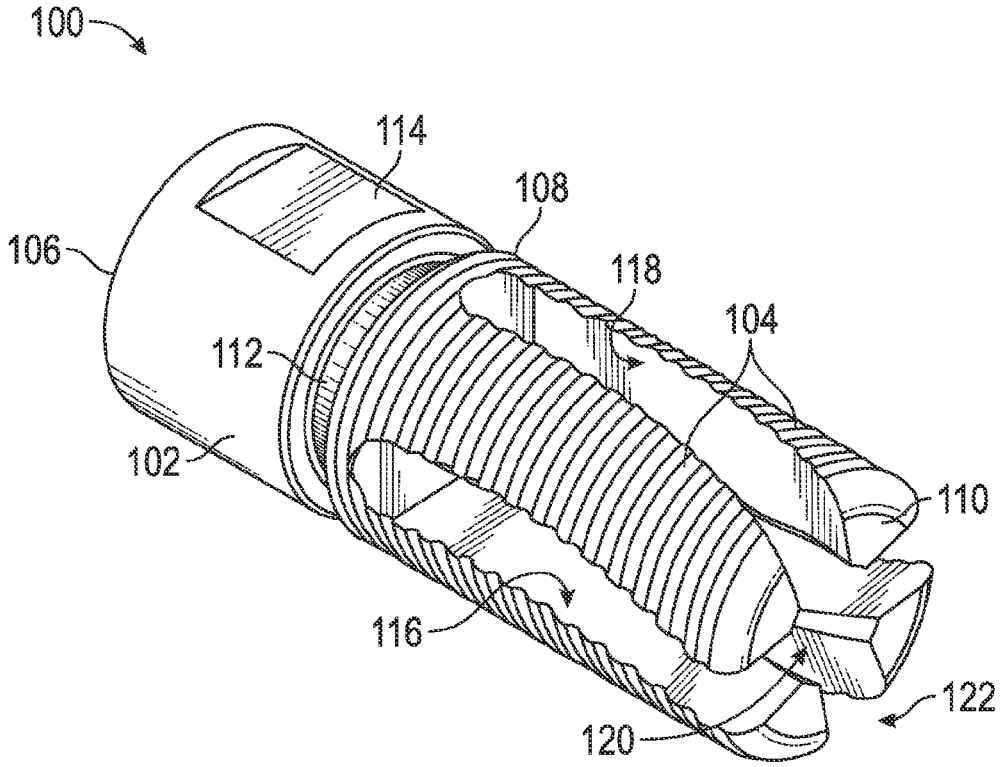
FIG. 1 representatively illustrates a front perspective view of a flash suppressor in accordance with an exemplary embodiment of the present technology.

Referring now to FIG. 1, in an exemplary embodiment of the present technology, a flash suppressor 100 may comprise a body 102 having a proximal first end portion 106 and a distal second end portion 110. The body 102 may comprise any device or system for reducing a flash exiting a barrel of a firearm after a projectile has been fired. For example, the body 102 may comprise a substantially cylindrical shape having a plurality of protrusions 104 extending at least part way between the first end portion 106 and the second end portion 110 of the body 102. The body 102 may comprise any suitable dimensions that may be determined, at least in part, according to the type of firearm the flash suppressor 100 is intended to be used with. For example, the body 102 may comprise an outer diameter of between about one-half inch and four inches and a length of between about one inch and five inches. The outer diameter may be substantially the same as an outer diameter of the barrel of the firearm the flash suppressor 100 is intended to be coupled to.

The body 102 may comprise any suitable material such as steel, iron, titanium, composite, plastic, and the like. The body 102 may be suitably adapted to withstand elevated temperatures associated with repeated and/or substantially continuous firing. The body 102 may also be adapted to be exposed to environmental conditions such as water, sunlight, and cold temperatures without becoming structurally and/or aesthetically compromised. For example, in one embodiment, at least a portion of the body 102 may be formed of a surface hardened 86L20 combat grade steel. The body 102 may further comprise any suitable surface finish or treatment.

Referring now to FIGS. 1-4, the body 102 may comprise an axial pathway 302 extending between a first interior point 304 and a second interior point 306 located along an interior mid-portion 108 of the body 102. The axial pathway 302 provides at least a portion of a pathway through the body 102 configured to allow the fired projectile to pass through the interior of the body 102 and exit the body 102 from the second end. portion 110. The axial pathway 302 may comprise any suitable diameter to provide sufficient area for the passage of the projectile. For example, the axial pathway 302 may comprise a diameter at least as large as a bore of the barrel of the firearm. The axial pathway 302 may be further configured to have a center aligned with a longitudinal axis 200 of the body when the flash suppressor 100 is coupled to the firearm.

Figure 7:
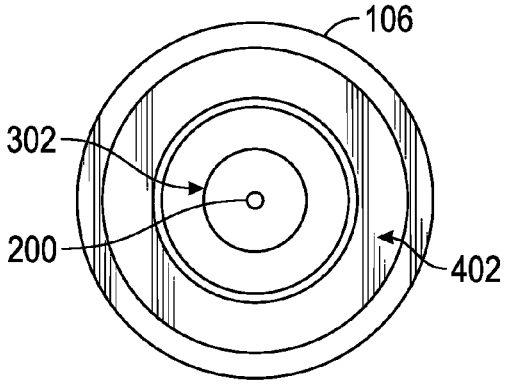
FIG. 7 representatively illustrates a rear view of a flash suppressor in accordance with an exemplary embodiment of the present technology.

Referring now to FIGS. 1 and 7, the body 102 may further comprise a recessed opening 402 located within the first end portion 106. The recessed opening 402 may be configured to allow the body 102 to be selectively coupled to the barrel of the firearm. The recessed opening 402 may comprise any suitable system or method for connecting the body 102 to the firearm. For example, in one embodiment, the recessed opening 402 may comprise an inner diameter suitably configured to receive the barrel of the firearm. The recessed opening 402 may be configured with a threaded inner wall 404 suitably adapted to allow the body 102 to be screwed onto a set of mating threads positioned along an exterior surface of the barrel. In a second embodiment, the body 102 may comprise one or more threaded apertures located along the first end portion 106 suitably configured to allow a set screw to be tightened against the barrel when inserted, into the recessed opening 402.

Figure 2:
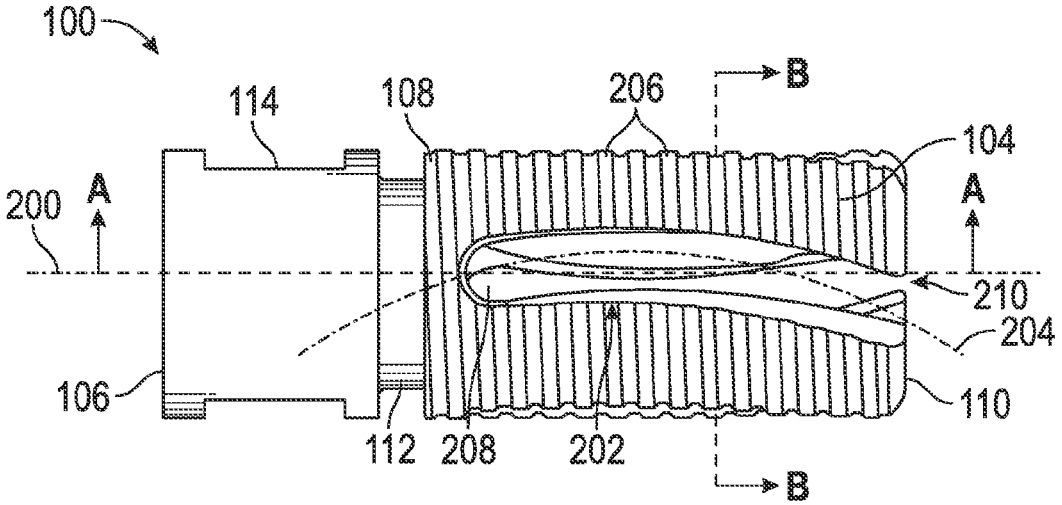
FIG. 2 representatively illustrates a side view of the flash suppressor in accordance with an exemplary embodiment of the present technology.
Figure 3:
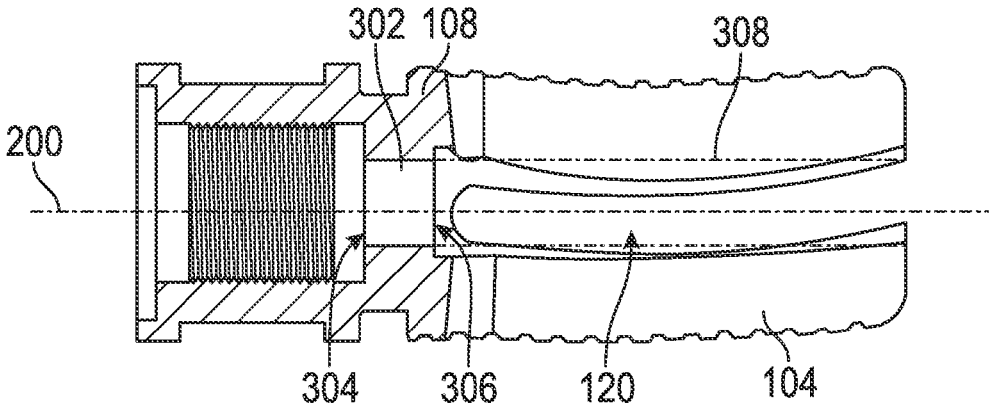
FIG. 3 representatively illustrates a cross-sectional view of the flash suppressor across line A-A of FIG. 2 in accordance with an exemplary embodiment of the present technology.
Figure 4:
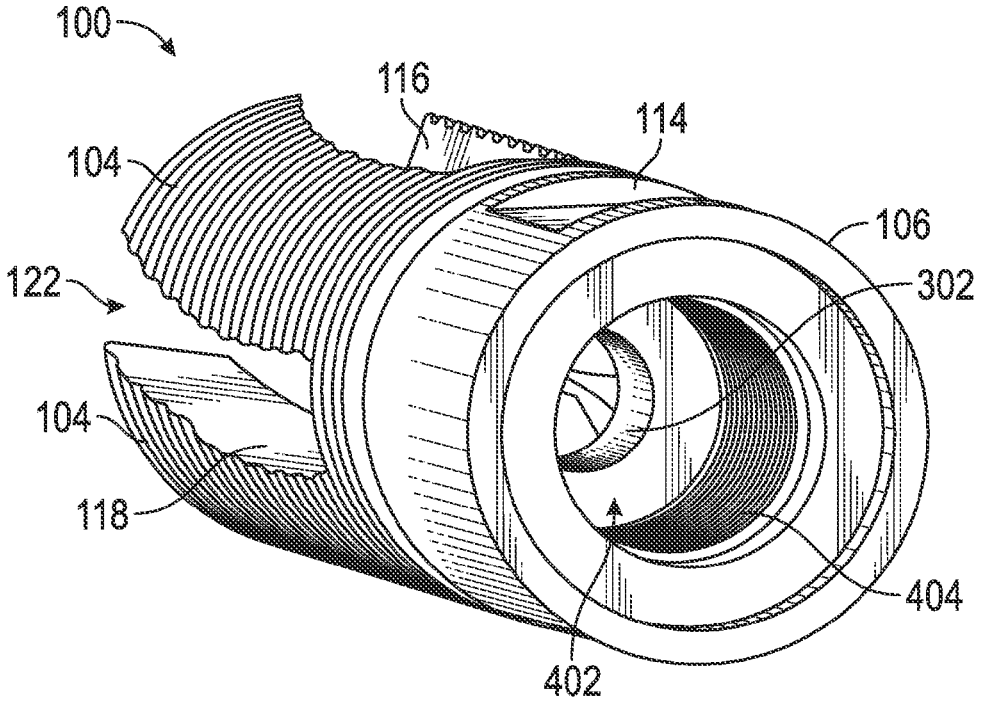
FIG. 4 representatively illustrates a rear perspective view of a flash suppressor in accordance with an exemplary embodiment of the present technology.

The body 102 may farther comprise one or more notches 114 positioned along an exterior surface of the body 102 to facilitate tightening of the body 102 to the barrel of the firearm. Referring now to FIGS. 1 and 2, the body 102 may also comprise at least one attachment ring 112 far securing a secondary object such as a blank firing device to the flash suppressor 100. For example, in one embodiment, an attachment ring 112 may be positioned along the body 102 between the first end portion 106 and the plurality of protrusions 104. In a second embodiment, an attachment ring 112 may be positioned along the plurality of protrusions 104 near the second end portion 110.

Referring again to FIGS. 1-4 and 6, the protrusions 104 may allow for reduced ignition of unburned gun powder exiting from the firearm during firing. The protrusions 104 may be configured in any suitable manner to dissipate gases and unburned materials exiting the barrel of the firearm. For example, the protrusions 104 may be arranged around the longitudinal axis 200 of the body 102 with a first end proximate to the second interior end 306 of the axial pathway 302 to form an exit chamber 120 extending from the mid-portion 108 to the second end portion 110 of the body 102.

The exit chamber 120 forms an interior space within the body 102 that is configured to allow a fired projectile to pass through the axial pathway 302 and continue its trajectory exiting the body 102 from the second end portion 110 unabated. The exit chamber 120 may comprise any suitable shape and/or dimensions for facilitating passage of the projectile. For example, in one embodiment, the exit chamber 120 may form a chamber pathway 308 having an inner diameter at least as large as the diameter of the axial pathway 302, wherein a center of the chamber pathway 308 is aligned, with the longitudinal axis 200. The chamber pathway 308 may extend from the second interior end 306 of the axial pathway 302 to the second end portion 110.

The body 102 may comprise any suitable number of protrusions 104. The number of protrusions 104 may be determined according to any suitable criteria, such as the outer diameter of the body 102, a type of firearm, a caliber of the projectile. and the like. With continued, reference to FIGS. 1-4, in one embodiment, the protrusions 104 may comprise flour flutes spaced equidistantly around a circumference from the longitudinal axis 200. The protrusions 104 may be arranged around the longitudinal axis 200 such that each protrusion 104 is separated from another protrusion 104 by a channel 122 extending at least part way between the two protrusions 104.

The channel 122 may comprise any suitable size and may be determined according to any suitable factors. In one embodiment, the channel 122 between protrusions may comprise a gap of between one-sixteenth and three-sixteenths of an inch. In a second embodiment, the channel 122 between each protrusion 104 may be at least one-quarter of an inch. The channel 122 may be configured in any suitable length. In one embodiment, the channel 122 may extend substantially the entire longitudinal length of the protrusions 104. In a second embodiment, the channel 122 may extend between about fifty and ninety-five percent of the longitudinal length of the protrusions 104. For example, the protrusions 104 may have a longitudinal length of about one and one-half inches and the channel 122 may have a longitudinal length of about one and thirteen-thirty-seconds of an inch.

Each flute may be curved transverse to the axial pathway 302 as each flute extends longitudinally from the mid-portion 108 to the second end portion 110 of the body 102. For example, each flute may comprise a first sidewall 116 and a second sidewall 118 that extend outward from the chamber pathway 302 to an exterior surface of the body 102. At least a portion of first sidewall 116 and/or the second sidewall 118 may define an arc along at least a portion of the longitudinal length of the flute such that the channel 122 between a first and second flute forms an arc-shaped opening 202 exposing the chamber pathway 302 to an ambient environment surrounding the body 102.

Referring now to FIG. 2, the arc-shaped opening 202 may comprise any suitable shape or size. For example, the arc-shaped opening 202 may comprise a closed end 208 proximate the mid-portion 108 and an open end 210 terminating at the second end portion 110. The closed end 208 may be configured in any suitable manner, such as having a curved radius connecting the first sidewall 116 of a first flute to the second sidewall 118 of a second flute or a substantially boxed end having squared corners. In one embodiment, the closed end 208 may comprise at least a portion of curve having a radius of between one-sixteenth and one-half of an inch.

The arc-shaped opening 202 may further be defined by a shape of the first sidewall 116 and the second sidewall 118. In one embodiment, the first and second sidewalls 116, 118 may comprise a corresponding arc shape such that the first sidewall 116 and the second sidewall 118 are substantially parallel to each other between the closed end 208 and the open end 210. For example, the first and second sidewalk 116, 188 may comprise an arc segment having a radius between one and one-half inches and two inches. In a second embodiment, the first and second sidewalls 116, 118 may comprise an arc segment having a radius between about one inch and four inches. In a third embodiment, the first sidewall 116 and the second sidewall 118 may comprise arc lengths having different radii such that the first sidewall 116 and the second sidewall 118 are not parallel to each other between the closed end 208 and the open end 210.

The arc-shaped opening 202 may be oriented in any suitable direction. For example, the arc-shaped opening 202 may be oriented to coincide with the rifling of the firearm such that reactive forces of exiting gases act on the sidewalls of the protrusions 104 to tighten the flash suppressor 100 onto the firearm. In one embodiment, the arc-shaped opening 202 may form a downward curve when viewed from a first side. In a second embodiment, the arc-shaped opening 202 may form an upward curve when viewed from the first side.

Figure 6:
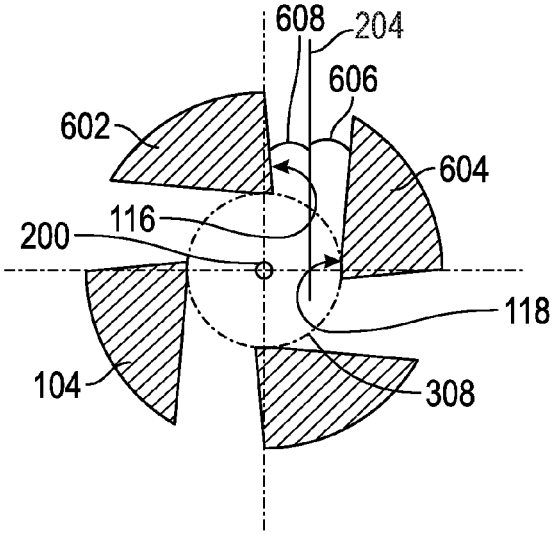
FIG. 6 representatively illustrates a cross-sectional view of the flash suppressor across line B-B of FIG. 2 in accordance with an exemplary embodiment of the present technology.

Referring now to FIGS. 2 and 6, the sidewalls of the protrusions 104 may facilitate expansion of the exiting gases, thereby decreasing the likelihood that unburned gun powder exiting the barrel will ignite due to high temperatures and/or high pressures created during the firing of the projectile. The sidewalls of the protrusions 104 may be configured in any suitable manner to allow gas expansion. For example, the first sidewall 116 of a first flute 602 and the second sidewall 118 of a second flute 604 may be tapered relative to a centerline 204 extending between the first sidewall 116 and the second sidewall 118. In one embodiment, the first sidewall 116 and second sidewall 118 may taper away from each other as each sidewall progresses outward from the chamber pathway 308.

The taper between each sidewall and the centerline 204 may comprise any suitable amount and may be fixed along the longitudinal length of the body 102 or may vary along the longitudinal length of the body 102. For example, the first sidewall 116 may taper from the centerline 204 by a first angle 608 and the second sidewall 118 may taper from the centerline 204 by a second angle 606. In one embodiment, the first angle 608 and the second angle 606 may taper between three and five degrees relative to the centerline 204. In a second embodiment, the taper of the first angle 608 and the second angle 606 may comprise an angle of up to fifteen degrees relative to the centerline 204.

The first angle 608 and the second angle 606 may be equal to each or they may differ. For example, in one embodiment, the first angle 608 and the second angle 606 may each be equal to about four and a half degrees relative to the centerline 204 such that the first sidewall 116 and the second sidewall 118 taper away from each other by combined amount of approximately nine degrees. In an alternative embodiment, the first angle 608 may be equal to about three and a half degrees and the second angle 606 may be equal to about seven degrees relative to the centerline 204 such that the first sidewall 116 and the second sidewall 118 taper away from each other by a combined amount of approximately ten and a half degrees.

Figure 5:
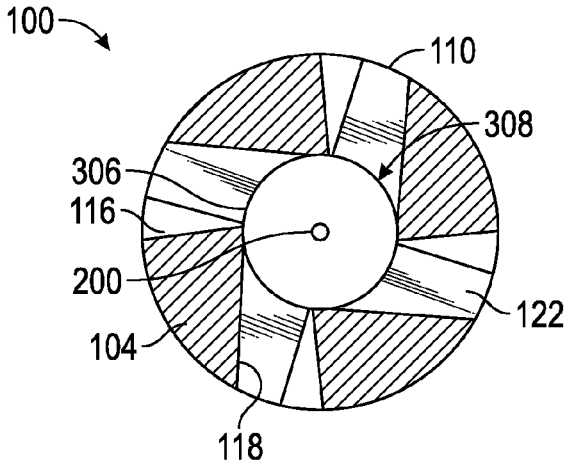
FIG. 5 representatively illustrates a front view of the flash suppressor in accordance with an exemplary embodiment of the present technology.

Referring now to FIGS. 5 and 6, the centerline 204 between pairs of protrusions 104 may be offset from a pair of bisecting centerlines running through the longitudinal axis 200. The centerline 204 may be offset from the longitudinal axis 200 by any suitable distance and the offset may be on either side of the longitudinal axis 200. For example, referring to FIG. 6, in one embodiment, the centerline 204 may be offset to the right of the longitudinal axis 200 by a distance of about three thirty-seconds of an inch. In a second embodiment, the centerline 204 may be offset from the longitudinal axis 200 by a distance of between one-thirty-second of an inch and one-sixteenth of an inch.

Referring again to FIGS. 1, 2, and 4, the body 102 may comprise a series of ridges or grooves 206 disposed along the exterior surface. For example, the grooves 206 may be inscribed into the outer surface of the protrusions 104. The grooves 206 may be suitably configured to collect unburned gun powder or other debris resulting from repeated firing of the firearm. The grooves 206 may be formed on the surface of the protrusions 104 by any suitable method. For example, in one embodiment, the grooves 206 may comprise a series of circular recesses inscribed into the outer surface of the protrusions 104. In a second embodiment, the grooves 206 may comprise a single recess inscribed into the surface of the protrusions 104 in a threaded manner.

In operation, the flash suppressor 100 may be screwed onto or otherwise attached to a barrel of a firearm. When a projectile is fired, the exiting projectile proceeds through the axial passageway 302 and through the chamber pathway 308. Any exiting propellant gases and/or unburned gun powder may not immediately ignite in the evacuated exit chamber, such as due to a lack of oxygen. These gases and unburned powder then disperse outward through the arc shaped openings 202 of the channels 122, resulting in a cooling and expansion of the gases, decreasing the likelihood of muzzle flash. Dispersal of the gases outward from the chamber pathway 308 may also decrease friction on the spinning projectile, making the bullet's trajectory more stable by decreasing the yaw of the projectile as it exits the flash suppressor 100.

The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the technology has been described with reference to specific exemplary embodiments. Various modifications and changes may be made, however, without departing from the scope of the present technology as set forth in the claims. The specification and figures are illustrative, rather than restrictive, and modifications are intended to be included within the scope of the present technology. Accordingly, the scope of the technology should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A flash suppressor for a barrel of a firearm, comprising:
a body, including:
a proximal end adapted for attachment to the barrel of the firearm;
a distal end including an exit chamber; and
an axial pathway defined through the body member connecting the proximal end to the exit chamber,
wherein the exit chamber includes:
a plurality of flutes, wherein the flutes are curved transverse to the axial passageway as the flutes extend from the axial passageway to the distal end, wherein:
an exterior surface portion of a first sidewall of a first flute defines a first arc along at least a portion of the longitudinal length of the first flute;
an exterior surface portion of a second sidewall of a second flute defines a second arc along at least a portion of the longitudinal length of the second flute; and
an arc-shaped opening is formed between the first arc and the second arc; and
a chamber pathway extending from the axial pathway to the distal end of the body, wherein the chamber pathway is open to an ambient environment through the arc-shaped opening.

2. A flash suppressor according to claim 1, wherein:
the first sidewall extends from an exterior surface of the exit chamber to the chamber pathway; and
the second sidewall extends from the exterior surface of the exit chamber to the chamber pathway, wherein the first sidewall and the second sidewall taper away from each other as each sidewall progresses outward from the chamber pathway relative to a centerline passing between the first sidewall and the second sidewall.

3. A flash suppressor according to claim 2, wherein:
the taper of the first sidewall relative to the centerline is between three and six degrees; and
the taper of the second sidewall relative to the centerline is between three and six degrees.

4. A flash suppressor according to claim 2, wherein the centerline between the first sidewall and the second sidewall taper is offset from a second centerline passing through a longitudinal axis of the body.

5. A flash suppressor according to claim 1, wherein the proximal end comprises a recessed opening having a threaded wall configured to be selectively coupled to a threaded exterior portion of the barrel of the firearm.

6. A flash suppressor according to claim 1, further comprising a plurality of grooves disposed along an exterior surface of the plurality of flutes.

7. A flash suppressor according to claim 1, further comprising a recessed ring channel disposed along an exterior surface of the body.

8. A flash suppressor for a barrel of a firearm, comprising:
a body, comprising:
a first end portion configured to couple to the barrel of the firearm;
a second end portion; and
an axial interior pathway disposed along an interior portion of the body between the first and second end portions, wherein the axial pathway is configured to align with the barrel of the firearm; and
a plurality of flutes arranged around a longitudinal axis of the body, wherein:
the plurality of flutes:
extend longitudinally along the body between the axial pathway and the second end portion; and
form a chamber pathway about the longitudinal axis of the body, wherein the chamber pathway aligned with the axial pathway; and
at least a portion of each flute is separated from another flute by a channel describing an arc-shaped opening extending at least part way between the first end portion and the second end portion, wherein:
an exterior surface portion of a first sidewall of a first flute defines a first arc along at least a portion of the longitudinal length of the first flute;
an exterior surface portion of a second sidewall of a second flute defines a second arc along at least a portion of the longitudinal length of the second flute; and
the arc-shaped opening is formed between the exterior surface portion of the first sidewall and the exterior surface portion of the second sidewall.

9. A flash suppressor according to claim 8, wherein the arc-shaped opening comprises a closed end proximate the axial pathway and an open end at the second end portion.

10. A flash suppressor according to claim 8, wherein each flute from the plurality of flutes comprises:
the first sidewall extends from an exterior surface of the body to the chamber pathway; and
the second sidewall extends from the exterior surface of the body to the chamber pathway, wherein the first sidewall and the second sidewall taper away from each other as each sidewall progresses outward from the chamber pathway relative to a centerline passing between the first sidewall and the second sidewall.

11. A flash suppressor according to claim 10, wherein:
the taper of the first sidewall relative to the centerline is between three and six degrees; and
the taper of the second sidewall relative to the centerline is between three and six degrees.

12. A flash suppressor according to claim 10, wherein the centerline between the first sidewall and the second sidewall taper is offset from a second centerline passing through the longitudinal axis of the body.

13. A flash suppressor according to claim 8, wherein the first end portion comprises a recessed opening configured to fit over the barrel of the firearm.

14. A flash suppressor according to claim 8, wherein the recessed opening comprises a threaded wall configured to be selectively coupled to a threaded portion of the barrel of the firearm.

15. A flash suppressor according to claim 8, further comprising a plurality of grooves disposed along an exterior surface of the plurality of flutes.

16. A flash suppressor according to claim 8, further comprising a recessed ring channel disposed along an exterior surface of the body.

17. A flash suppressor for a barrel of a firearm, comprising:

a body including a plurality of protrusions extending along and arranged around a longitudinal axis of the body, wherein:

the plurality of protrusions forms a chamber pathway about the longitudinal axis of the body configured to align with a center bore of the barrel; and at least a portion of each protrusion is separated from another protrusion by a channel describing an arc-shaped opening extending at least part way along the body, wherein:

an exterior surface portion of a first sidewall of a first protrusion defines a first arc along at least a portion of the longitudinal length of the first protrusion;

an exterior surface portion of a second sidewall of a second protrusion defines a second arc along at least a portion of the longitudinal length of the second protrusion; and the arc-shaped opening is formed between the exterior surface portion of the first sidewall and the exterior surface portion of the second sidewall.

18. A flash suppressor according to claim 17, wherein the arc-shaped opening comprises a closed end along a mid-portion of the body and an open end at an end portion of the body.

19. A flash suppressor according to claim 17, wherein:

the first sidewall extends from an exterior surface of the body to the chamber pathway; and the second sidewall extends from the exterior surface of the body to the chamber pathway, wherein the first sidewall and the second sidewall taper away from each other as each sidewall progresses outward from the chamber pathway relative to a centerline passing between the first sidewall and the second sidewall.

20. A flash suppressor according to claim 19, wherein:

the taper of the first sidewall relative to the centerline is between three and six degrees; and the taper of the second sidewall relative to the centerline is between three and six degrees.

21. A flash suppressor according to claim 19, wherein the centerline between the first sidewall and the second sidewall taper is offset from a second centerline passing through the longitudinal axis of the body.

22. A flash suppressor according to claim 17, further comprising:

a coupler disposed at a second end portion of the body, wherein the coupler is configured to couple to the barrel of the firearm; and an axial pathway disposed along an interior portion of the body at least partway between the coupler and the plurality of protrusions, wherein the axial pathway is configured to align with a center bore of the barrel and the chamber pathway.

23. A flash suppressor according to claim 22, wherein the coupler comprises a recessed opening configured to fit over the barrel of the firearm.

24. A flash suppressor according to claim 23, wherein the recessed opening comprises a threaded wall configured to be selectively coupled to a threaded portion of the barrel of the firearm.

25. A flash suppressor according to claim 17, further comprising a plurality of grooves disposed along an exterior surface of the plurality of flutes.

26. A flash suppressor according to claim 17, further comprising a recessed ring channel disposed along an exterior surface of the body.

* * * * *